United States Patent [19]

Hedlund et al.

[11] Patent Number: 4,976,496

[45] Date of Patent: Dec. 11, 1990

[54] VALVE OPENABLE IN RESPONSE TO DISPLACEMENT OF A CUTTING TOOL

[75] Inventors: Jan-Gunnar Hedlund, Sandviken; Bengt A. Asberg, Gävle, both of Sweden

[73] Assignee: Sandvik AB, Sandviken, Sweden

[21] Appl. No.: 377,167

[22] Filed: Jul. 10, 1989

[30] Foreign Application Priority Data

Jul. 19, 1988 [SE] Sweden ..... 8802674

[51] Int. Cl.[5] ..... E21B 10/60; E21C 35/22

[52] U.S. Cl. ..... 299/81; 175/393

[58] Field of Search ..... 299/81, 1; 175/339, 175/340, 393

[56] References Cited

U.S. PATENT DOCUMENTS

| | | | |
|---|---|---|---|
| 4,456,306 | 6/1984 | Wrulich et al. | 299/81 |
| 4,488,759 | 12/1984 | Bergevist | 299/81 |
| 4,542,942 | 9/1985 | Zitz et al. | 299/81 |
| 4,555,143 | 11/1985 | Wrulich et al. | 299/81 |
| 4,569,558 | 2/1986 | Hood | 299/81 |
| 4,664,450 | 5/1987 | Radford | 299/81 |

FOREIGN PATENT DOCUMENTS

| | | | |
|---|---|---|---|
| 1126766 | 6/1982 | Canada | 299/81 |
| 0060827 | 9/1982 | European Pat. Off. | 299/81 |
| 2192565 | 1/1988 | United Kingdom . | |

*Primary Examiner*—Bruce M. Kisliuk

*Attorney, Agent, or Firm*—Burns, Doane, Swecker & Mathis

[57] ABSTRACT

A tool is mounted in a holder, the holder including a fluid passage for discharging drilling fluid toward a cutting zone. Fluid flow is regulated by a valve in the holder. The valve includes a housing and a valve element movable in the housing. The valve element opens the valve in response to rearward displacement of the tool relative to the holder. The housing of the valve is also rearwardly displaceable relative to the holder whenever rearward forces transmitted from the tool are excessive, thereby avoiding the occurrence of damage to the valve. The valve housing is yiealdably biased forwardly by fluid pressure in the conduit.

15 Claims, 2 Drawing Sheets

VALVE OPENABLE IN RESPONSE TO DISPLACEMENT OF A CUTTING TOOL

BACKGROUND OF THE INVENTION

The present invention relates to a valve intended to be mounted in a holder of a tool for cutting solid materials, the valve being activated by axial displacement of the tool in the holder. The invention also relates to a device for fluid supply.

In relation to mineral cutting tools it is previously known to provide fluid supply when the tool is activated, said supply usually being controlled via a valve that is activated by the axial displacement of the tool. This prior art is exemplified by British Patent No. 2,192,565 published Jan. 20, 1988.

A frequent disadvantage of the known valve arrangements is that the valve housing is mounted in the holder via a thread connection that naturally gives rise to a relatively complicated mounting. A further frequent disadvantage in such tools is that as the support surface of the holder for the collar of the mineral cutting tool becomes worn, increased axial displacement of the tool is possible. However, the valves cannot manage this which means that those valves are damaged and stop working.

The present invention has the aim of presenting a valve of the type specified above, the valve having a floating mount in order to eliminate the disadvatages described above.

SUMMARY OF THE INVENTION

The aim of the present invention is realized by a holder apparatus to receive a tool for cutting solid material. The holder apparatus comprises a holder body containing a recess. A forward portion of the recess is arranged to receive a tool in such manner that the tool is rearwardly displaceable relative to the housing. The holder body includes a fluid channel for conducting and discharging fluid to a cutting zone. A valve comprises a valve housing disposed in a rear portion of the recess. The valve housing includes a fluid inlet communicating with an upstream portion of the channel, and a fluid outlet communicating with the downstream portion of the channel. A valve element is mounted in the valve housing between valve opening and valve closing positions. The valve element is yieldably biased to the valve closing position and is adapted to be displaced to the valve opening position in response to rearward movement of a tool relative to the housing, to enable fluid to be discharged to the cutting zone. The valve housing is yieldably biased forwardly and is arranged to be displaced rearwardly relative to the recess when rearwardly directed forces acting against the housing overcome forces biasing the housing forwardly. The present invention also relates to the combination of housing and a cutting tool, as well as to a valve per se, usable in combination with a tool and housing.

BRIEF DESCRIPTION OF THE DRAWING

Below an embodiment of the invention will be described, reference being made to the accompanying drawings, wherein.

DETAILED DESCRIPTION OF A PREFERRED EMBODIMENT OF THE INVENTION

Figure 1:
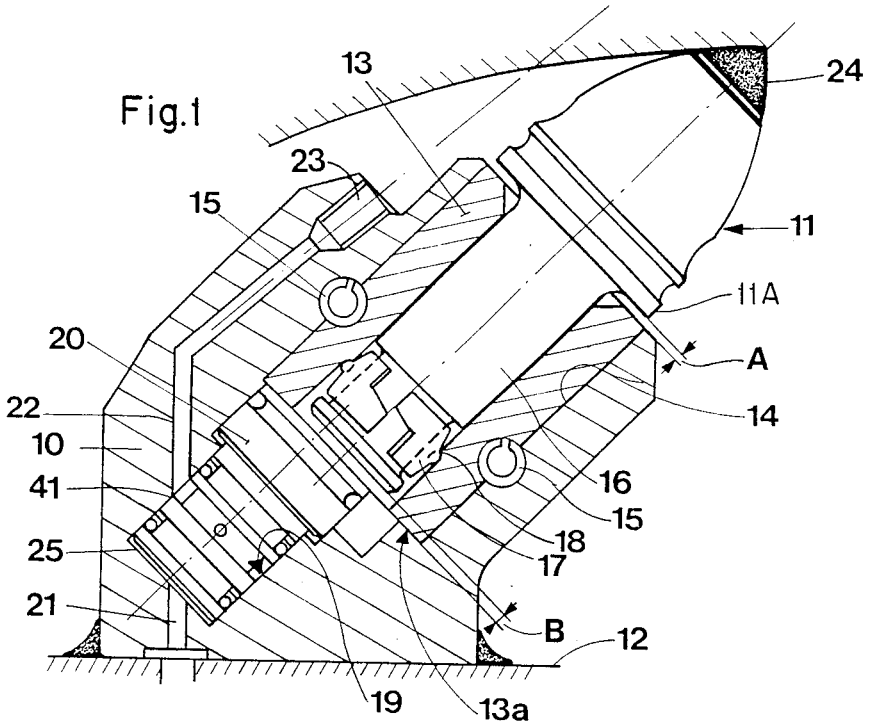
FIG. 1 shows a partly sectioned side view of a device according to the invention.

Shown in FIG. 1 rotatably supports a mineral tool 11 having a collar 11*a*. The holder 10 is welded to a part 12 of a machine for cutting of solid materials, e.g. a cutting head or a cutting drum. A seat for the tool 11 is defined by a sleeve 13 that is received in a recess 14 in a body of the holder 10. Between the lower end of the sleeve 13 and the holder 10 there is a play 13*a* that makes it possible for the sleeve 13 to be displaced a limited distance axially downwards in the holder 10. The sleeve 13 is secured in the axial direction by resilient tube pins 15. The engagement of the tube pins 15 with the sleeve 13 makes possible the axial displacement of the sleeve 13. In order to secure the tool 11 in the axial direction a locking ring 17 is provided upon the shaft 16 of the tool 11, the locking ring 17 cooperating with a step 18 of the sleeve 13. The maximum axial displacement of the tool 11 in its inoperative position according to FIG. 1 before the collar 11A strikes the sleeve 13 has been designed by A.

As is evident from FIG. 1 the holder 10 is provided with a further recess 19. A valve 20 according to the present invention is mounted in the recess 19. A first channel portion 21 for supply of fluid ends in the recess 19 while a second channel portion 22 for supply of fluid starts from the recess 19 and emanates in a nozzle 23. Fluid is sprayed through the nozzle towards the area of the tip 24 of the mineral tool 11. In its inoperative position the valve 20 cuts off the connection between the channel portions 21 and 22. While in its operative position, the valve 20 provides a connection between the channel portions 21 and 22.

In FIG. 1 the inoperative position of the valve 20 is shown, the valve by the fluid pressure being forced against the lower end of the sleeve 13. In this position there is a play 25 between the bottom of the recess 19 and the valve 20. The distance between the stop surface of the valve 20 contacting the sleeve 13 and the free end of the shaft 16 is designated by B.

Figure 2:
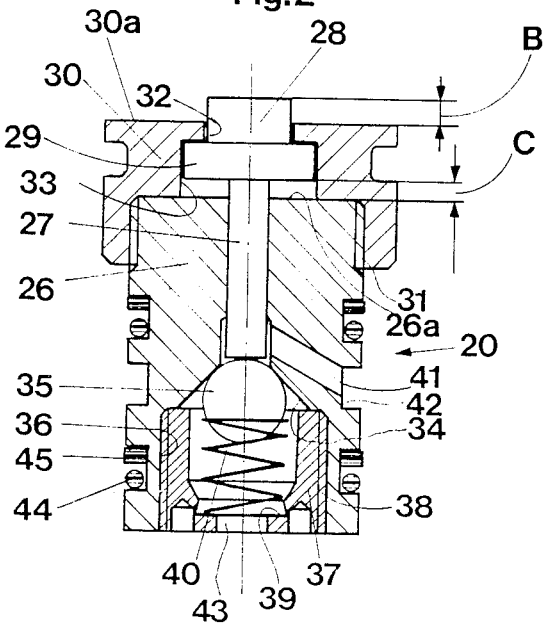
FIG. 2 shows a partly sectioned side view of a valve according to the invention.

The structural composition of the embodiment of the valve 20 described in the present application is evident from FIG. 2.

In a valve housing 26 a push-rod 27 of a valve element is axially displaceably mounted, the push-rod 27 being provided with an operating means 28 at the end that extends out of the valve housing. In FIG. 2 a collar 29 is located below the operating means 28. A stop ring 30 is secured to the valve housing 26 via a thread connection 31. An opening 32 for the operating means 28 and a recess 33 for the collar 29 are provided in the stop ring 30. In the shown position in FIG. 2, i.e. the inoperative position of the valve 20, the collar 29 contacts an overhang of the recess 33 while the operating means extends out of the opening 32 a distance B that corresponds to the distance B in FIG. 1. A play C between the collar 29 and the valve housing 26 defines the maximum stroke for the push-rod 27.

In the area of the end of the push-rod 27 that is directed from the operating means 28, the valve housing 26 is provided with a conical seat 34 that receives a ball 35 of the valve element. The seat 34 is transformed into a cylindrical recess 36 in a direction away from the push-rod 27, the recess 36 receiving a plug 37 via a thread connection 38. The plug 37 has a support surface 39 for a compression spring 40 having its other end abutting the ball 35 and forcing the ball into abutment with the seat. A connection channel 41 is provided in the valve housing 26 and extends from the area of the end of the push-rod 27 contacting the ball 35 to a groove 42 on the periphery of the valve housing 26.

As pointed out above, the spring 40 forces the ball 35 against the seat 34. Also the fluid pressure acts upon the ball 35 via an opening 43 in the plug 37. When the push-rod 27 displaces the ball downwards against a counter-acting spring force and fluid pressure, it is possible for fluid to pass through the connection channel 41 and thereby the channel portions 21 and 22 are indirectly connected to each other.

Upon the periphery of the valve housing 26, different types of seal rings 44, 45 are provided, the seal rings 44, 45 sealing against the recess 19 on both sides of the groove 42.

Figure 3:
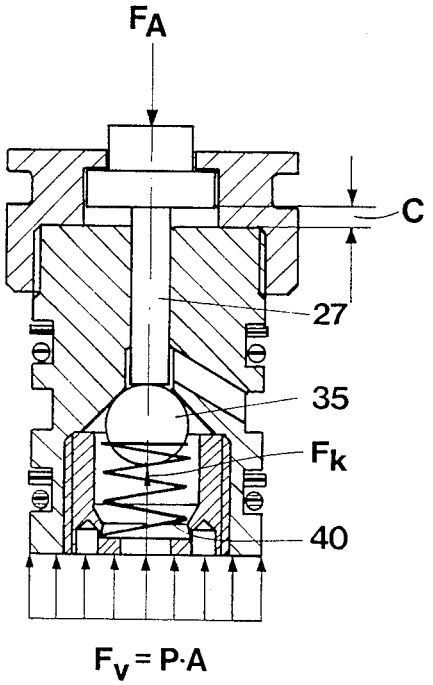
FIG. 3 schematically shows the forces that act upon the valve according to the invention.

In FIG. 3 the forces acting upon the the valve 20 are schematically shown. The force $F_A$ designates the force that the axial displacement of the tool 11 transmits to the push-rod 27 of the valve 20. $F_V$ designates the entire force generating from the fluid pressure P that is acting upon the valve 20, the force $F_V$ being equal to the fluid pressure P multiplied by the area A that the pressure P is acting upon. $F_K$ designates the force that is acting upon the ball 35, the force in the disclosed embodiment being composed of the force generated by the fluid pressure P and the force generated by the spring 40. The above definitions mean that the force $F_K$ includes the force on the ball generated by fluid pressure P.

The function of the valve is controlled by the following conditions:

1. $F_A < F_K$ means that the ball 35 is closed.

2. $F_K \leqq F_A \leqq F_V$ means that the ball 35 is open but no displacement of the valve 20 has taken place.

3. $F_A > F_V$ means that the ball 35 is open and the valve 20 has been displaced in a direction towards the bottom of the recess 19. However, that displacement is only effected a distance corresponding to the play 25 between the valve 20 and the bottom of the recess 19.

The device according to FIG. 1 is functioning in the following way. When an axial force $F_A$ directed towards the holder 10 is acting upon the tool 11, that tool is displaced a direction towards the valve 20. The free end of the shaft 16 of the tool 11 will thereby, via the operating means 28, displace the push-rod 27 in a direction towards the ball 35 and open the ball.

In this connection it should be noted that there is no risk of the valve housing 26 being displaced towards the bottom of the recess, a distance corresponding to the play 25 that exists between the valve housing 26 and the bottom of the recess 19. The reason, therefor, is that the fluid pressure is so chosen that the force $F_V$ by which the fluid pressure urges the valve 20 towards the sleeve 13 is essentially higher than the force by which the spring 40 urges the ball 35 against the seat 34. Certainly the ball 35 is also affected by the fluid pressure but the entire force $F_K$ acting upon the ball 35 is still essentially smaller than the force $F_V$ by which the valve 20 is urged towards the sleeve 13. In this connection it should be pointed out that for certain applications the spring 40 can be omitted.

When the tool 11 has been displaced the available axial distance designated by A in FIG. 1, the push-rod 27 will also have been displaced the corresponding distance to open the ball 35. Initially one also makes sure that $A < C$, where C is the play between the collar 29 and the upper stop surface 26a of the valve housing 26. Initially one also makes sure that $B > C$ so as to give the operating means 28 a certain wear margin. This can be summarized in the condition $A < C < B$, which means that the tool 11 will contact the upper end of the sleeve 13. If $F_A > F_V$, the entire sleeve 13 is displaced but only a maximum distance corresponding to the play 13a. This displacement is counteracted by the force $F_V$ and therefore that displacement takes place in a dampened manner.

When the free end of the sleeve 13 and/or the opposing collar of the tool 11 is worn, the distance A will increase. Simultaneously a certain wear of the operating means 28 will have taken place. This means that A may now be greater than C and B. If $A > B > C$, contact is established between the free end of the shaft 16 and the stop surface 30a of the stop ring 30 during the ball-opening process. A certain displacement of the entire valve 20 will thereby take place if $F_A > F_V$. This displacement of valve 20 is possible due to the play 25 that exists between the valve 20 and the bottom of the reces 19. If $A > C < B$, the collar 29 will contact the stop surface 26a of the valve housing 26, which also means that a certain displacement of the entire valve will take place if the above-listed condition No. 3 is fulfilled. The play 25 absorbs this displacement. Since normal values of $F_A = 10$–$40$ kilo Newtons (depending on the rock) and normal values of $F_V = 10$–$20$ kilo Newtons occur, a dampened displacement of the sleeve 13 and/or the valve 20 takes place.

From FIG. 1 it is evident that the center axes of the tool 11 and the valve 20, respectively, are eccentrically located relative to each other. This means a uniform wear of the free end of the shaft 16 occurs since the tool 11 rotates in the holder 10.

As noted earlier, the apparatus is initially designed so that the condition $B > C > A$ takes place. This condition also takes place when reconditioning the device by replacing parts thereof.

The invention is in no way restricted to the embodiment described above. The invention is also applicable for nonrotating tools for cutting of solid materials. Other types of valves other than a ball valve can also be used. The invention can also be varied freely within the scope of the appending claims.

We claim:

1. A holder apparatus adapted to receive a tool for cutting solid material, said holder apparatus comprising:

a holder body containing:

a recess, a forward portion of said recess arranged to receive the tool in such manner that the tool is rearwardly displaceable relative to said housing, and fluid channel means for conducting and discharging fluid in a direction of flow toward a cutting zone of the tool, valve means comprising:

a valve housing disposed in a rear portion of said recess, said housing including a fluid inlet communicating with an upstream portion of said channel means considered with respect to said direction of flow, and a fluid outlet communicating with a downstream portion of said channel means, a valve element mounted in said valve housing for movement between valve opening and valve closing positions, said valve element yieldably biased to said valve closing position and adapted to be displaced to said valve opening position in response to rearward movement of the tool relative to said housing to enable fluid to be discharged toward the cutting zone, said valve housing being yieldably biased forwardly and arranged to be displaced rearwardly relative to said recess when rearwardly directed forces acting against said housing overcome forces biasing said housing forwardly.

2. A holder apparatus according to claim 1, wherein said valve housing is biased forwardly by fluid in said channel means.

3. A holder apparatus according to claim 2, wherein said valve element is arranged to be biased to a valve closing position by fluid in said channel means.

4. A holder apparatus according to claim 3 including a spring for biasing said valve element to a valve closing position.

5. A holder apparatus according to claim 1 including a removable sleeve mounted in said forward portion of said recess for receiving said tool, said valve housing being biased forwardly and against said sleeve.

6. A holder apparatus according to claim 1, wherein said valve element and said housing include cooperating stop means for limiting the extent of movement of said valve element.

7. A holder apparatus according to claim 6, wherein said valve housing includes a seat disposed between said fluid inlet and outlet, said valve element including a seat-engaging portion biased toward said seat.

8. Apparatus for cutting solid material comprising:

a tool including a front cutting end and a rear mounting shaft, a holder receiving said tool, said holder including:

a recess having a forward portion and a rear portion, a removable sleeve mounted in said forward portion of said recess, said sleeve receiving said mounting shaft of said tool in a manner permitting said tool to move rearwardly relative to said sleeve in response to engaging material to be cut, fluid channel means for conducting and discharging fluid in a direction of flow toward a cutting zone of the tool, valve means comprising:

a valve housing disposed in said rear portion of said recess, said housing including a fluid inlet communicating with an upstream portion of said channel means considered with reference to said direction of flow, a fluid outlet communicating with a downstream portion of said channel means, and a valve seat between said fluid inlet and fluid outlet, and a valve element mounted in said valve housing, said valve element including a seat-engging portion movable toward and away from said seat to valve closing and valve opening positions, respectively, said seat-engaging portion being yieldably biased to said valve closing position, and a valve rod having a rear end operably engageable with said seat-engaging portion and a front operating portion projecting forwardly beyond said valve housing, said front operating portion disposed behind said mounting shaft of said tool and arranged to be engaged and moved rearwardly thereby in response to rearward movement of said tool relative to said sleeve for moving said seat-engaging portion to a valve opening position and enabling fluid to be discharged to the cutting zone, said housing being yieldably biased forwardly against a rear end of said sleeve and arranged to be displaced rearwardly relative to said recess when rearwardly directed forces transmitted to said housing from said tool overcome forces biasing said housing forwardly.

9. Apparatus according to claim 8, wherein said valve housing is biased forwardly by fluid pressure in said channel means.

10. Apparatus according to claim 9, wherein said seat-engaging portion is arranged to be biased toward said seat by fluid in said channel means.

11. Apparatus according to claim 10 including a spring biasing said seat-engaging portion toward said seat.

12. Apparatus according to claim 8, wherein said tool includes a collar adapted to abut said sleeve after said tool travels a first rearward distance relative to said holder, said valve means including a stop surface for limiting the rearward movement of said valve rod relative to said valve housing to a second distance, said second distance being greater than said first distance.

13. Apparatus according to claim 12, wherein said tool includes a collar adapted to abut said sleeve after said tool travels a first rearward distance relative to said holder, said first distance being shorter than the extent by which said valve rod extends forwardly past said valve housing.

14. A valve adapted to be mounted in a tool holder such that said valve is opened in response to rearward movement of a tool in the holder for transmitting fluid to a cuttin zone; said valve comprising a valve housing adapted to be freely movable within the tool holder, said housing having fluid inlet and outlet portions and a seat therebetween, and a front stop surface having an opening therethrough; a valve element mounted in said housing, said valve element including a seat-engaging portion movable toward and away from said valve seat, and a movable valve rod of smaller cross-section than said opening projecting forwardly through said opening and beyond said front stop surface by a first distance, said valve rod operably connected to said seat-engaging portion for displacing said seat-engaging portion rearwardly away from said seat when said valve rod is displaced rearwardly, said valve element including a collar disposed between said valve rod and said seat-engaging portion, said housing including an additional stop surface disposed between said collar and said valve seat and spaced from said collar by a second distance which is no greater than said first distance.

15. A valve according to claim 14, wherein said second distance is less than said first distance.

* * * * *